US011389928B2

(12) United States Patent
Lee et al.

(10) Patent No.: US 11,389,928 B2
(45) Date of Patent: Jul. 19, 2022

(54) METHOD FOR CONDITIONING POLISHING PAD

(71) Applicant: TAIWAN SEMICONDUCTOR MANUFACTURING CO., LTD., Hsinchu (TW)

(72) Inventors: Shen-Nan Lee, Hsinchu County (TW); Te-Chien Hou, Kaohsiung (TW); Teng-Chun Tsai, Hsinchu (TW); Chung-Wei Hsu, Hsinchu County (TW); Chen-Hao Wu, Keelung (TW)

(73) Assignee: TAIWAN SEMICONDUCTOR MANUFACTURING CO., LTD., Hsinchu (TW)

( * ) Notice: Subject to any disclaimer, the term of this patent is extended or adjusted under 35 U.S.C. 154(b) by 428 days.

(21) Appl. No.: 16/141,680

(22) Filed: Sep. 25, 2018

(65) Prior Publication Data

US 2019/0160628 A1 May 30, 2019

Related U.S. Application Data

(60) Provisional application No. 62/592,746, filed on Nov. 30, 2017.

(51) Int. Cl.

| | |
|---|---|
| ***B24B 53/017*** | (2012.01) |
| ***B24B 49/12*** | (2006.01) |
| ***B24B 49/00*** | (2012.01) |
| ***B24B 37/32*** | (2012.01) |

(52) U.S. Cl.

CPC ..... *B24B 53/017* (2013.01); *B24B 37/32* (2013.01); *B24B 49/003* (2013.01); *B24B 49/12* (2013.01)

(58) Field of Classification Search

None

See application file for complete search history.

(56) References Cited

U.S. PATENT DOCUMENTS

| | | | | |
|---|---|---|---|---|
| 5,951,370 | A * | 9/1999 | Cesna | B24B 37/20 451/21 |
| 7,070,479 | B2 * | 7/2006 | Faustmann | B24B 49/16 451/21 |
| 7,413,986 | B2 * | 8/2008 | Paik | B24B 37/042 438/690 |
| 7,899,571 | B2 | 3/2011 | Basim et al. | |
| 9,138,860 | B2 * | 9/2015 | Dhandapani | B24B 53/017 |
| 9,156,122 | B2 * | 10/2015 | Shinozaki | B24B 49/18 |
| 2005/0070209 | A1 * | 3/2005 | Marxsen | B24B 53/02 451/5 |
| 2009/0318060 | A1 | 12/2009 | Dhandapani et al. | |

(Continued)

FOREIGN PATENT DOCUMENTS

| | | |
|---|---|---|
| CN | 1535196 A | 10/2004 |
| CN | 101817162 A | 9/2010 |

(Continued)

*Primary Examiner* — Joseph J Hail
*Assistant Examiner* — Jonathan R Zaworski
(74) *Attorney, Agent, or Firm* — Maschoff Brennan

(57) ABSTRACT

A method is provided and includes: measuring a surface profile of a polishing pad; obtaining a reference profile of the polishing pad; comparing the surface profile of the polishing pad with the reference profile to generate a difference result; determining a conditioning parameter value according to the difference result; and conditioning the polishing pad using the conditioning parameter value.

20 Claims, 9 Drawing Sheets

(56) References Cited

U.S. PATENT DOCUMENTS

| | | | | |
|---|---|---|---|---|
| 2010/0291844 | A1* | 11/2010 | Sakamoto | B24B 53/017 451/443 |
| 2012/0270477 | A1 | 10/2012 | Nangoy et al. | |
| 2012/0309267 | A1* | 12/2012 | Shinozaki | B24B 53/005 451/8 |
| 2013/0122783 | A1* | 5/2013 | Menk | B24B 37/042 451/11 |
| 2018/0085888 | A1* | 3/2018 | Hendron | B24B 37/22 |

FOREIGN PATENT DOCUMENTS

| | | | |
|---|---|---|---|
| CN | 102858495 | A | 1/2013 |
| CN | 204868552 | U | 12/2015 |
| JP | 2016-179513 | A | 10/2016 |
| TW | 200507981 | A | 3/2005 |
| TW | 2012/10745 | A1 | 3/2012 |

* cited by examiner

METHOD FOR CONDITIONING POLISHING PAD

PRIORITY CLAIM AND CROSS-REFERENCE

This application claims priority to U.S. Provisional Application Ser. No. 62/592,746, filed Nov. 30, 2017, which is herein incorporated by reference.

BACKGROUND

In semiconductor fabrication, integrated circuits and semiconducting devices are formed by sequentially forming features in sequential layers of material in a bottom-up manufacturing method. The manufacturing process utilizes a wide variety of deposition techniques to form the various layered features including various etching techniques such as anisotropic plasma etching to form device feature openings followed by deposition techniques to fill the device features. In order to form reliable devices, close tolerances are required in forming features including anisotropic etching techniques which rely heavily on layer planarization to form consistently deep anisotropically etched features.

In addition, excessive degrees of surface nonplanarity will undesirably affect the quality of several semiconductor manufacturing processes including, for example, photolithographic patterning processes, where positioning the image plane of the process surface within an increasingly limited depth of focus window is required to achieve high resolution semiconductor feature patterns.

Chemical mechanical polishing (CMP) is increasingly being used as a planarizing process for semiconductor device layers. CMP planarization is typically used several different times in the manufacture of a multi-level semiconductor device, including planarizing levels of a device containing both dielectric and metal portions to achieve global planarization for subsequent processing of overlying levels. A conventional CMP device includes a rotating polishing pad. A problem with the CMP operation is that the polishing surface of the polishing pad can become uneven during wafer processing. An uneven polishing surface cannot polish a wafer properly and may result in uneven or defective wafer processing.

BRIEF DESCRIPTION OF THE DRAWINGS

Aspects of some embodiments of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
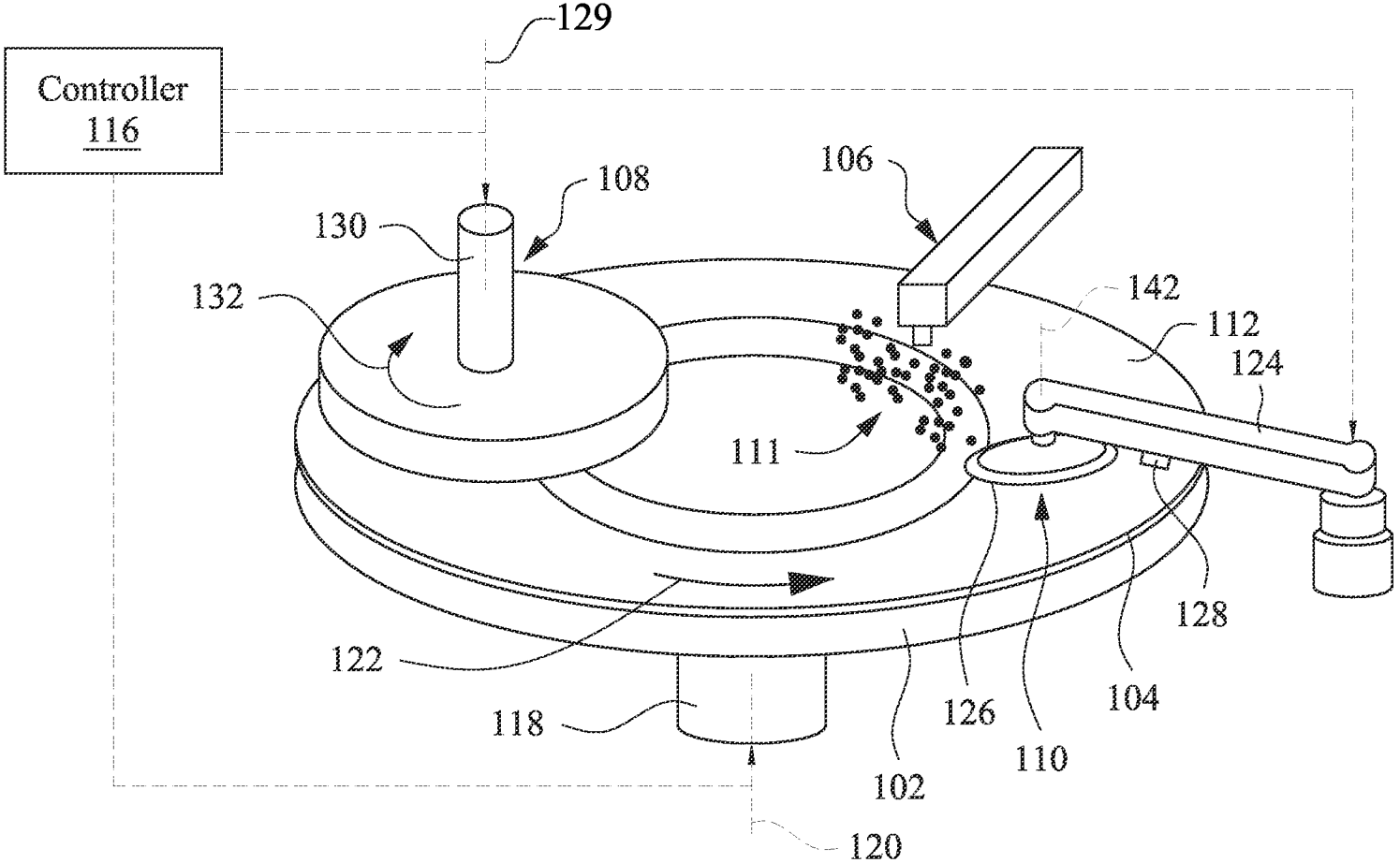
FIG. 1 shows a schematic diagram of a CMP system in accordance with some embodiments.

The following disclosure provides many different embodiments, or examples, for implementing different features of the provided subject matter. Specific examples of components and arrangements are described below to simplify some embodiments of the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, some embodiments of the present disclosure may repeat reference numerals and/or letters in the various examples. This repetition is for the purpose of simplicity and clarity and does not in itself dictate a relationship between the various embodiments and/or configurations discussed.

Some embodiments of the present disclosure are directed to a CMP process. A surface profile of a polishing pad is measured and compared with a reference profile to generate a difference result. A conditioning parameter value is determined according to the difference result, and the polishing pad is conditioned using the conditioning parameter value. The conditioning parameter value is used to control the rate of the material removed from the polishing pad. Therefore, the profile of the polishing pad is controlled to approach the reference profile.

Figure 2:
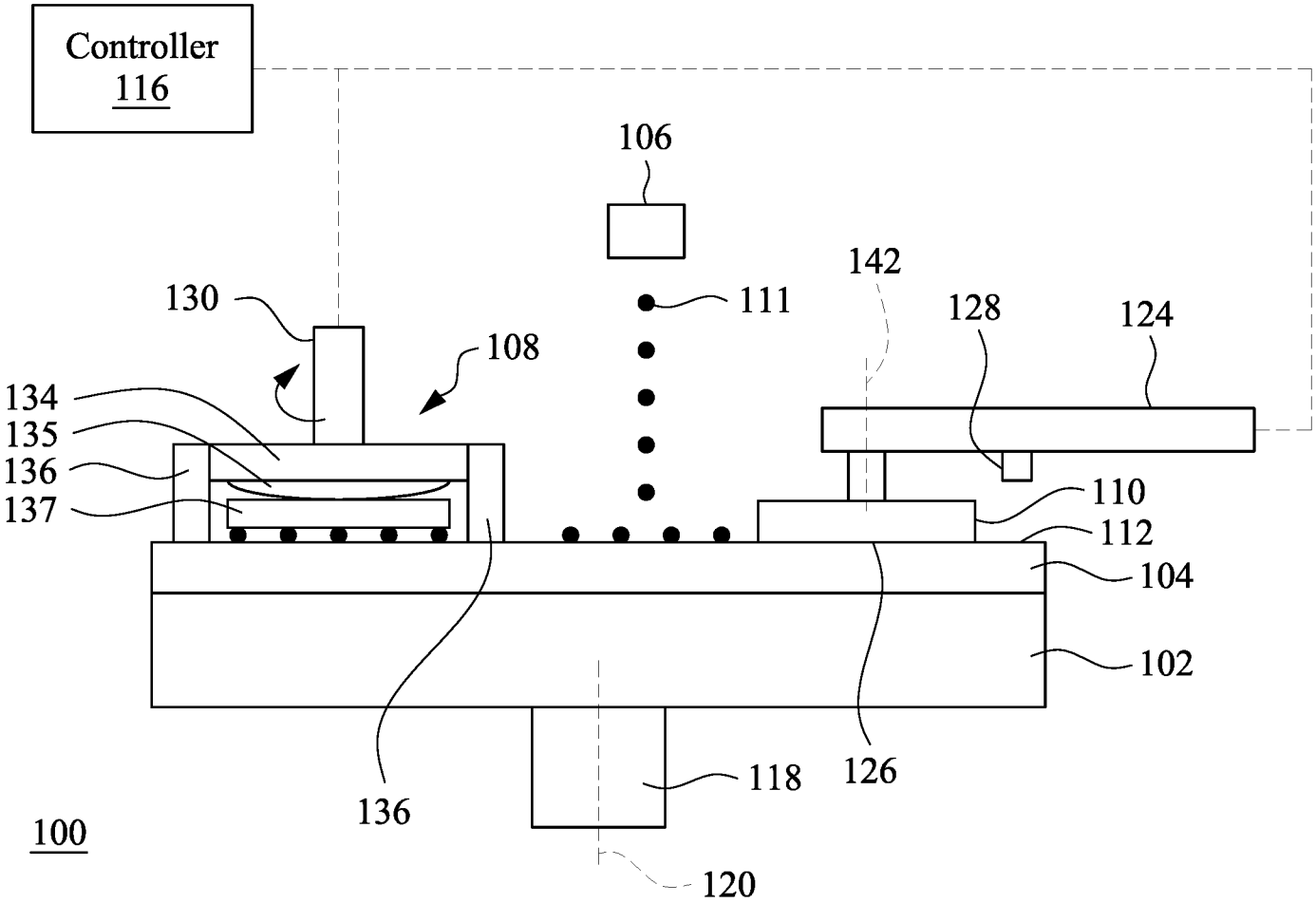
FIG. 2 shows a cross-sectional view of the CMP system in accordance with some embodiments.

FIG. 1 shows a schematic diagram of a CMP system 100 in accordance with some embodiments. FIG. 2 shows a cross-sectional view of the CMP system 100 in accordance with some embodiments. Referring to FIG. 1 and FIG. 2, the CMP system 100 includes a platen 102, a polishing pad 104, a slurry arm 106, a wafer carrier 108, and a conditioner 110. In some embodiments, the CMP system 100 can process wafers that have a diameter of 1-inch (25 mm); 2-inch (51 mm); 3-inch (76 mm); 4-inch (100 mm); 5-inch (130 mm) or 125 mm (4.9 inch); 150 mm (5.9 inch, generally referred to as "6 inch"); 200 mm (7.9 inch, generally referred to as "8 inch"); 300 mm (11.8 inch, generally referred to as "12 inch"); 450 mm (17.7 inch, generally referred to as "18 inch"), for example.

A CMP controller 116 may be a processor, any form of computer, or a circuit. Prior to wafer planarization, the slurry arm 106 dispenses slurry 111, which contains abrasive slurry particles, onto a polishing surface 112 of the polishing pad 104 before wafer planarization occurs. The controller 116 then rotates the platen 102 and the polishing pad 104 (for example, via a platen spindle 118) about a polishing pad axis 120 as shown by a first angular velocity arrow 122. As the polishing pad 104 rotates, the conditioner 110, which is pivoted via a scan arm 124 and rotated about a disk axis 142, moves over the polishing pad 104 such that a conditioning surface 126 of the conditioner 110 is in frictional engagement with the polishing surface 112 of the polishing pad 104. In this configuration, the conditioner 110 scratches or "roughs up" the polishing surface 112 continuously during polishing to help ensure consistent and uniform planarization.

The wafer carrier 108 includes a head 134, a membrane 135, and a retaining ring 136. The retaining ring 136 surrounds a wafer 137. The membrane 135 is disposed on a downward surface of the head 134 to press the wafer 137. The controller 116 also rotates the wafer 137 housed within the wafer carrier 108 about a wafer axis 129 (e.g., via a wafer carrier spindle 130) as shown by a second angular velocity arrow 132. While the dual rotations (represented as the angular velocity arrows 122, 132) occur, the wafer 137 is pressed into the slurry 111 and the polishing surface 112 with a downforce applied by the wafer carrier 108. The combination of the slurry 111, the dual rotations, and the down-force planarizes the lower surface of the wafer 137 until an endpoint for the CMP operation is reached.

In some CMP operations, the wafer 137 is housed within the wafer carrier 108 with upward suction so as to keep the wafer 137 raised above the lower face of the retaining ring 136. When the platen 102 and the polishing pad 104 are rotated, the wafer carrier 108 is lowered, the retaining ring 136 is pressed onto the polishing pad 104, with the wafer 137 recessed just long enough for the wafer carrier 108 to reach a polishing speed. When the wafer carrier 108 reaches the polishing speed, the wafer 137 is lowered facedown to contact the polishing surface 112 of the polishing pad 104 and/or the slurry 111, so that the wafer 137 is substantially flush with and constrained outwardly by the retaining ring 136.

After CMP, the wafer carrier 108 and the wafer 137 are lifted, and a post-CMP cleaning operation is performed. For example, the polishing pad 104 is subjected to a high-pressure spray of deionized water to remove slurry residue and other particulate matter from the polishing pad 104. Other particulate matter may include wafer residue, CMP slurry, oxides, organic contaminants, mobile ions and metallic impurities. The wafer 137 is then referred to a polished wafer.

The CMP system 100 also includes a sensor 128 disposed on the scan arm 124 for measuring a profile of the polishing pad 104. The profile includes thicknesses at various locations. In some embodiments, the sensor 128 detects the distance from the sensor 128 to the polishing surface 112 of the polishing pad 104. The thickness of the polishing pad is calculated by subtracting the measured distance from a known distance between the sensor 128 and the bottom of the polishing pad 104. The sensor 128 can be configured to take measures at incremental radial positions across the polishing pad 104 when the scan arm 124 moves. In other words, the length of the scan arm 124 may be long enough to move the sensor 128 across the polishing pad 104. By moving the sensor 128 across the rotating polishing pad 104, the thicknesses of all location of the polishing pad 104 can be measured.

The sensor 128 can detect the thickness of the polishing pad 104 in various different ways. In some embodiments, multiple sensors 128 are disposed on the scan arms 124, and each sensor 128 detects the thickness of the polishing pad 104 at different locations. In some embodiments, the sensor 128 is disposed on the conditioner 110. In some embodiments, the sensor 128 is disposed on another movable device/unit/apparatus for detecting the thickness of the polishing pad 104 at various locations. In some embodiments, multiple sensors 128 may be mounted in a fixed manner across the radius or diameter of the polishing pad 104. Each sensor 128 may be mounted over a different radial position of the polishing pad 104. Since there are multiple sensors 128, distance measurements can be made simultaneously without needing to move the sensors 128. Since the sensors 128 are not coupled to a moving mechanism, there is less chance of positional errors due to the movement of the sensors 128. In some embodiments, the sensors 128 may be mounted in a staggered manner, in which each sensor 128 has a different radial position over the polishing pad 104. As the polishing pad 104 rotates, the system can take thickness measurements, so as to record the thicknesses for all areas of the polishing pad 104.

In some embodiments, the thicknesses for different radial positions across the polishing pad 104 are measured. The measurements may be averaged to determine the thickness of each concentric circular area of the polishing pad 104. By combining all of the average thickness measurements across the polishing pad 104, a polishing pad profile may be generated. A new polishing pad 104 has a uniform profile and a planar polishing surface initially. As the polishing pad 104 wears, the thickness of the polishing pad 104 will decrease. Since the polishing pad 104 rotates, it will wear in a circular pattern around the center of rotation. In some embodiments, the thicknesses for locations all over the polishing pad 104 are detected. The thicknesses for the entire polishing pad 104 can then be mapped in a grid of such as a X, Y coordinate system or a polar coordinate system.

Various polishing pad thickness detection methods are applicable to embodiments of the disclosure. For example, in some embodiments, the controller 116 may take multiple thickness measurement readings and discard the higher and lower readings and average the remaining readings. Thus, any individual measurement errors in the sensor detection will be filtered out. Since the surface of the polishing pad is not perfectly smooth, an average of many measurements may produce a relatively accurate indication of the pad thickness.

Figure 3A:
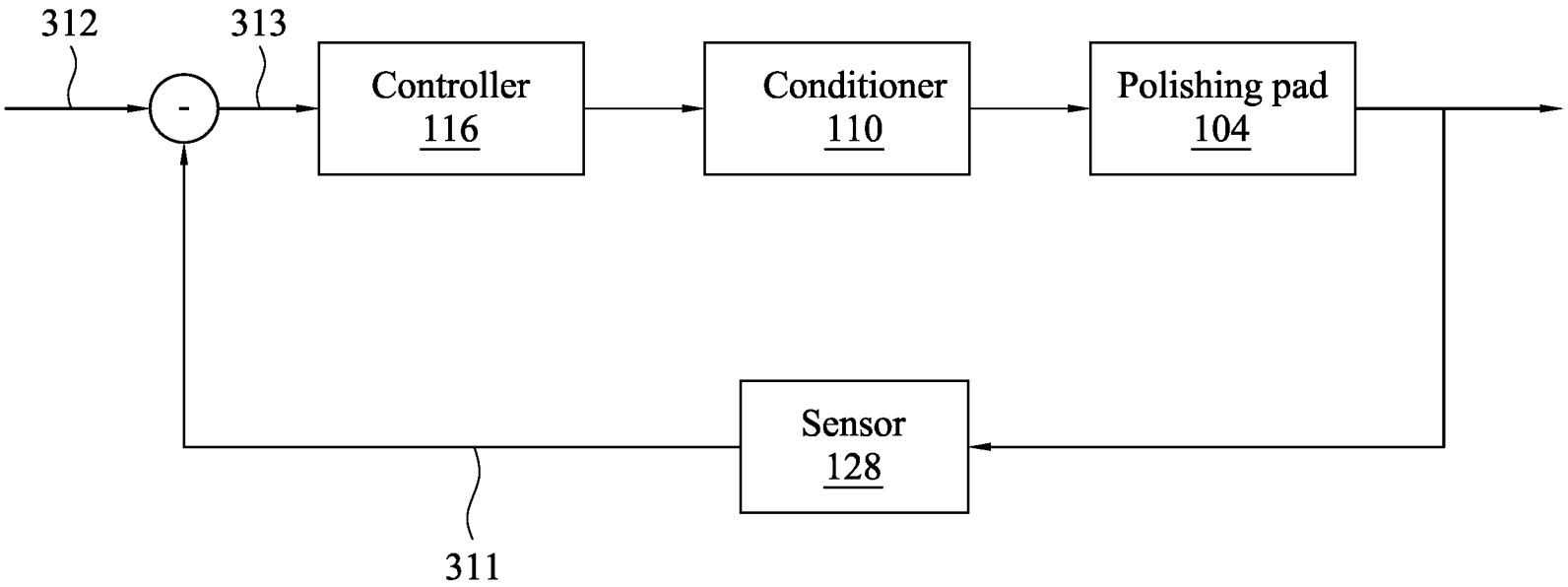
FIG. 3A is a schematic diagram illustrating closed loop control in accordance with some embodiments.

FIG. 3A is a schematic diagram illustrating closed loop control in accordance with some embodiments. Referring to FIG. 3A, in a feedback loop, the sensor 128 measures a surface profile 311 of the polishing pad 104, in which the surface profile 311 includes multiple thicknesses at various locations. The controller 116 compares the surface profile 311 with a reference profile 312 to generate a difference result 313. The controller 116 determines a conditioning parameter value of the conditioner 110 according to the difference result 313. The polishing pad 104 is conditioned using the conditioning parameter value so as to control the rate of the material removed from the polishing pad 104. For example, the conditioning parameter value may be a downforce value to the conditioner 110 that urges the conditioner 110 against the polishing pad 104 or speed value of sweeping the conditioner 110 across the polishing pad 104. The higher the downforce value of the conditioner 110 is, the more material of the polishing pad 104 would be removed. The less the sweeping speed value of the conditioner 110 is, the more material of the polishing pad 104 would be removed because the conditioner 110 stays at a particular location longer. In other words, the profile of the polishing pad 104 may be controlled by adjusting the downforce value or the sweeping speed value of the conditioner 110. For example, if the controller 116 determines that the thickness at a first location is too high compared with the reference profile, then it may increase the downforce value or decrease the sweeping speed value of the conditioner 110 at the first location.

In some embodiments, a closed loop control is performed to monitor and adjust the surface profile of the polishing pad. Any suitable control method is applicable to the closed loop control. For example, proportional-integral-derivative (PID) feedback control, PI control or P control may be adopted. In general, after the difference result 313 is calculated, the controller 116 makes appropriate correction to the conditioning parameter value in order to reduce the difference between the surface profile 311 and the reference profile 312. The controlling mechanism will be described below. In some embodiments, a multi-loop closed loop control may be adopted. For example, an inner loop controls one of the downforce value and the sweeping speed value, and an outer loop controls the other one of the downforce value and the sweeping speed value.

Figure 3B:
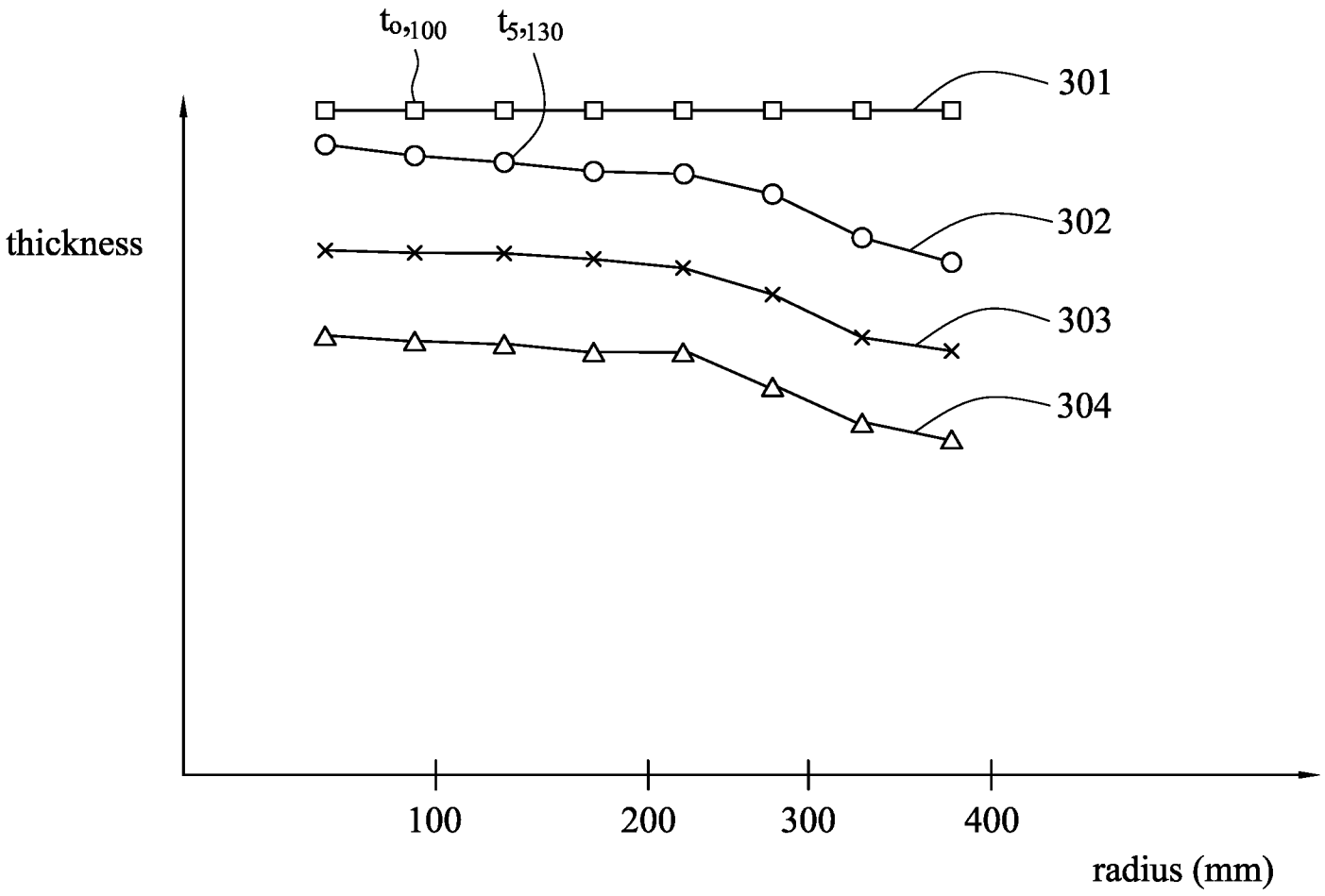
FIG. 3B is a diagram showing various profiles of a polishing pad in accordance with some embodiments.

FIG. 3B is a diagram showing various profiles of the polishing pad in accordance with some embodiments. Four profiles 301-304 are shown in FIG. 3B and they represent the same polishing pad after different numbers of wafers are processed. For example, the profile 301 includes thicknesses of a polishing pad before processing wafers, i.e. a new polishing pad; the profile 302 includes the thicknesses of the polishing pad after several wafers are processed; the profile 303 includes the thicknesses of the polishing pad after more wafers are processed than those for the profile 302; and the profile 304 includes the thicknesses of the polishing pad after even more wafers are processed than those for the profile 303. Note that FIG. 3B is just an example for explanation, and different scenarios may lead to different profiles. In the embodiment of FIG. 3B, the thickness of the polishing pad 104 decreases as the radius increases and the overall thicknesses decrease as more wafers are polished. For clarity, $t_{i,j}$ denotes the thickness of the polishing pad 104 at radius j after i wafers are polished, where i is an integer and j is a real number representing a coordinate in a X, Y coordinate system or a polar coordinate system. For example, when the real number j represents a coordinate in the polar coordinate system, $t_{0,100}$ of the profile 301 denotes the thickness of a new polishing pad at radius 100 millimeters (mm), and $t_{5,130}$ of the profile 302 denotes the thickness of the polishing pad at radius of 130 mm after 5 wafers are polished.

In some embodiments, a previous profile of the polishing pad serves as the reference profile, and thus a thickness tendency is maintained. For example, assume that the profile 304 is the current surface profile, and the profile 302 is the reference profile. A current thickness tendency of the surface profile at a first location is calculated by applying a high pass filter to the thicknesses of the surface profile around the first location. For example, the high pass filter may be written as [−1, 0, 1], in which the middle coefficient "0" corresponds to the thickness where the high pass filer is applied, and the left coefficient "−1" corresponds to the left thickness in the profile, and the right coefficient "1" corresponds to the right thickness in the profile. When this high pass filter is applied to the location j, the current thickness tendency is $t_{cur,j+1}-t_{cur,j-1}$, where $t_{cur,j+1}$ is the thickness of the current profile at location (j+1), and so on. A reference thickness tendency of the reference profile at the first location is calculated by applying the same high pass filter to the thicknesses of the reference profile around the first location. For example, when this high pass filter is applied to the location j of the reference profile 302, the reference thickness tendency is $t_{cur-k,j+1}-t_{cur-k,j-1}$, where k is a positive integer which may be 1, 5, 10, or any other suitable number. The conditioning parameter value with respect to the first location is determined so that the current thickness tendency approaches the reference thickness tendency. For example, when the current thickness tendency is greater than the reference thickness tendency, it means the surface profile around the location j increases faster, and therefore the downforce value of the conditioner at the location j may be increased, or the sweeping speed value of the conditioner at the location j may be decreased. Note that the high pass filter [−1, 0, 1] is just an example, and the coefficients and the size of the filter are not limited in the disclosure. For example, the filter may be [−1, 1] where either coefficient could correspond to the thickness where the filter is applied. Alternatively, the filter may be [1, 0, 0, 0, −1] where the leftmost or right most coefficient corresponds to the thickness where the filter is applied.

The thickness tendency calculation is independent with respect to various locations. To be specific, a first current thickness tendency of the surface profile at a first location (e.g. location j) may be calculated. A second current thickness tendency of the surface profile at a second location (e.g. location j+1) may be calculated. A first reference thickness tendency of the reference profile at the first location j is calculated. A second reference thickness tendency of the reference profile at the second location (j+1) is calculated. The conditioning parameter value with respect to the first location j is determined according to the first current thickness tendency and the first reference thickness tendency. The conditioning parameter value with respect to the second location (j+1) is determined according to the second current thickness tendency and the second reference thickness tendency. In particular, the conditioning parameter value with respect to the location j may be different from the conditioning parameter value with respect to the location (j+1).

In some embodiments, the conditioning parameter value is controlled such that the difference between the surface profile of the polishing pad and the reference profile is within a predetermined range. For example, the surface profile includes thicknesses $t_{cur,j}$ and $t_{cur,ref}$; the reference profile includes thicknesses $t_{cur-k,j}$ and $t_{cur-k,ref}$ in which ref indicates any location other than the location cur, and $0 \le k \le cur$. For example, when k=cur, the reference profile is a profile of a new polishing pad prior to processing a wafer; when k<cur, the reference profile is a profile of the polishing pad after processing at least one wafer. In some embodiments, the location ref is 350 mm where the smallest thickness occurs. The following equations (1) to (3) are performed.

$$e_j = t_{cur,j} - t_{cur-k,j} \tag{1}$$

$$e_{ref} = t_{cur,ref} - t_{cur-k,ref} \tag{2}$$

$$d_j = e_j - e_{ref} \tag{3}$$

In the equation (1), a first thickness difference $e_j$ between the current thickness $t_{cur,j}$ and the reference thickness $t_{cur-k,j}$ is calculated. In the equation (2), a second thickness difference $e_{ref}$ between the current thickness $t_{cur,ref}$ and the reference thickness $t_{cur-k,ref}$ is calculated. Note that both of the current thickness $t_{cur,j}$ and the reference thickness $t_{cur-k,j}$ are at the location j, and both of the current thickness $t_{cur,ref}$ and the reference thickness $t_{cur-k,ref}$ are at the location ref. In the equation (3), a third thickness difference $d_j$ between the thickness difference $e_j$ and the thickness difference $e_{ref}$ is calculated. The controller 116 determines whether the third thickness difference $d_j$ is in a pre-determined range (e.g. 0 to ±R mm, in which R may be 0.1, 0.2, 2, 3, 4 mm, or any other suitable value). If the third thickness difference $d_j$ is not within the pre-determined range, the controller 116 modifies the conditioning parameter value with respect to the location j according to the third thickness difference $d_j$. For example, when the thickness difference $d_j$ is greater than 0.2, then the downforce value of the conditioner at the location j may be increased, or the sweeping speed value of the conditioner at the location j may be decreased. If the thickness difference $d_j$ is in the pre-determine range, the controller 116 adopts the default conditioning parameter value or the latest conditioning parameter value with respect to the location j to control the conditioner. In some embodiments, the thickness difference $d_j$ is inputted to the closed loop control to control the conditioning parameter value with respect to the location j.

Note that the equations (1) to (3) may be applied to every location j of the polishing pad. Accordingly, the conditioning parameter value with respect to the location j is determined independently. For example, the conditioning parameter value with respect to a first location may be different from the conditioning parameter value with respect to a second location in which the first location is different from the second location.

In some embodiments, the equation (1) is performed but not the equations (2) and (3). The thickness difference $e_j$ means the "thickness loss". The controller 116 determines if the thickness difference $e_h$ is in a pre-determined range (e.g. 0 to ±R mm, in which R may be 0.1, 0.2, 2, 3, 4 mm, or any other suitable value). If the thickness difference $e_j$ is not in the pre-determined range, the controller 116 modifies the conditioning parameter value with respect to the location j according to the thickness difference $e_j$. For example, if the thickness difference $e_j$ is smaller than −0.5, the controller 116 decreases the downforce value or increases the sweeping speed value of the conditioner with respect to the location j. If the thickness difference $e_j$ is in the pre-determine range, the controller 116 adopts the default conditioning parameter value or the latest conditioning parameter value with respect to the location j to control the conditioner. In some embodiments, the thickness difference $e_j$ is inputted to a closed loop control to control the conditioning parameter value with respect to the location j.

In some embodiments, the reference thickness $t_{cur-k,j}$ and the reference thickness $t_{cur-k,ref}$ in the equations (1) to (3) may be replaced with other thicknesses. For example, the reference thickness $t_{cur-k,j}$ may be replaced with the thickness $t_{0,j}$ of a new polishing pad at the location j, and the reference thickness $t_{cur,ref}$ may be replaced with the thickness $t_{0,ref}$ of the new polishing pad at the location ref. In some embodiments, the reference thickness $t_{cur-k,j}$ may be replaced with an average of multiple thicknesses of the polishing pad at the location j corresponding to multiple polished wafers. In other words, the reference profile is an average profile of multiple profiles of the polishing pad after processing multiple wafers. For example, an average of the multiple thicknesses $t_{a_1,j}$, $t_{a_2,j}$, . . . , $t_{a_m,j}$ is calculated where $0 \le a_1, a_2, \ldots a_m < cur$. Similarly, the reference thickness $t_{cur-k,ref}$ may be replaced with an average of the thicknesses $t_{a_1,ref}$, $t_{a_2,ref}$, . . . , $t_{a_m,ref}$ of the polishing pad at the location ref corresponding to multiple polished wafers where $0 \le a_1, a_2, \ldots a_m < cur$. However, the values and the number of the positive integers $a_1, a_2, \ldots a_m$ are not limited in the disclosure.

In some embodiments, the current thickness at another location serves as the reference profile. To be specific, the surface profile includes a current thickness $t_{cur,j}$, and the reference profile includes another current thickness $t_{cur,ref}$ in which the location j is different from the location ref. A thickness difference between the current thickness $t_{cur,j}$ and the current thickness $t_{cur,ref}$ is calculated as the following equation (4).

$$se_j = t_{cur,j} - t_{cur,ref} \tag{4}$$

The controller 116 determines if the thickness difference $se_j$ is in a pre-determined range (e.g. 0 to ±R mm, in which R may be 0.1, 0.2, 2, 3, 4 mm, or any other suitable value). If the thickness difference $se_j$ is not in the pre-determined range, the controller 116 modifies the conditioning parameter value with respect to the location j. For example, if the thickness difference $se_j$ is greater than 0.4 mm, the controller 116 increases the downforce value or decreases the sweeping speed value of the conditioner with respect to the location j. If the thickness difference $se_j$ is in the pre-determine range, the controller 116 adopts the default conditioning parameter value or the latest conditioning parameter value with respect to the location j to control the conditioner. In these embodiments, the reference profile is a "flat profile" in which the thicknesses of the polishing pad are uniform. In some embodiments, the thickness difference $se_j$ is inputted to a closed loop control to control the conditioning parameter value with respect to the location j.

In some embodiments, an average of multiple current thicknesses serves as the reference profile. To be specific, the sensor 128 detects the thicknesses $t_{cur,m}$, where $m \in C$, and C denotes an area of the polishing pad. Note that the area C may represent the whole polishing pad 104 or a portion of the polishing pad 104. The controller 116 calculates an average thickness $t_{cur,avg}$ according to the following equation (5).

$$t_{cur,avg} = \frac{1}{|C|} \sum_{m \in C} t_{cur,m} \tag{5}$$

The controller 116 calculates the thickness difference as $t_{cur,j} - t_{cur,avg}$. The controller 116 also determines whether the thickness difference $t_{cur,j} - t_{cur,avg}$ is within a pre-determined range. If the thickness difference is not within the pre-determined range, the controller 116 modifies the conditioning parameter value with respect to the location j. For example, if the thickness difference $t_{cur,j} - t_{cur,avg}$ is greater than 0.4 mm, the controller 116 increases the downforce value or decreases the sweeping speed value of the conditioner with respect to the location j. If the thickness difference $t_{cur,j} - t_{cur,avg}$ is in the pre-determine range, the controller 116 adopts the default conditioning parameter value or the latest conditioning parameter value with respect to the location j to control the conditioner. In some embodiments, the thickness difference $t_{cur,j} - t_{cur,avg}$ is inputted to a closed loop control to control the conditioning parameter value with respect to the location j.

Figure 4:
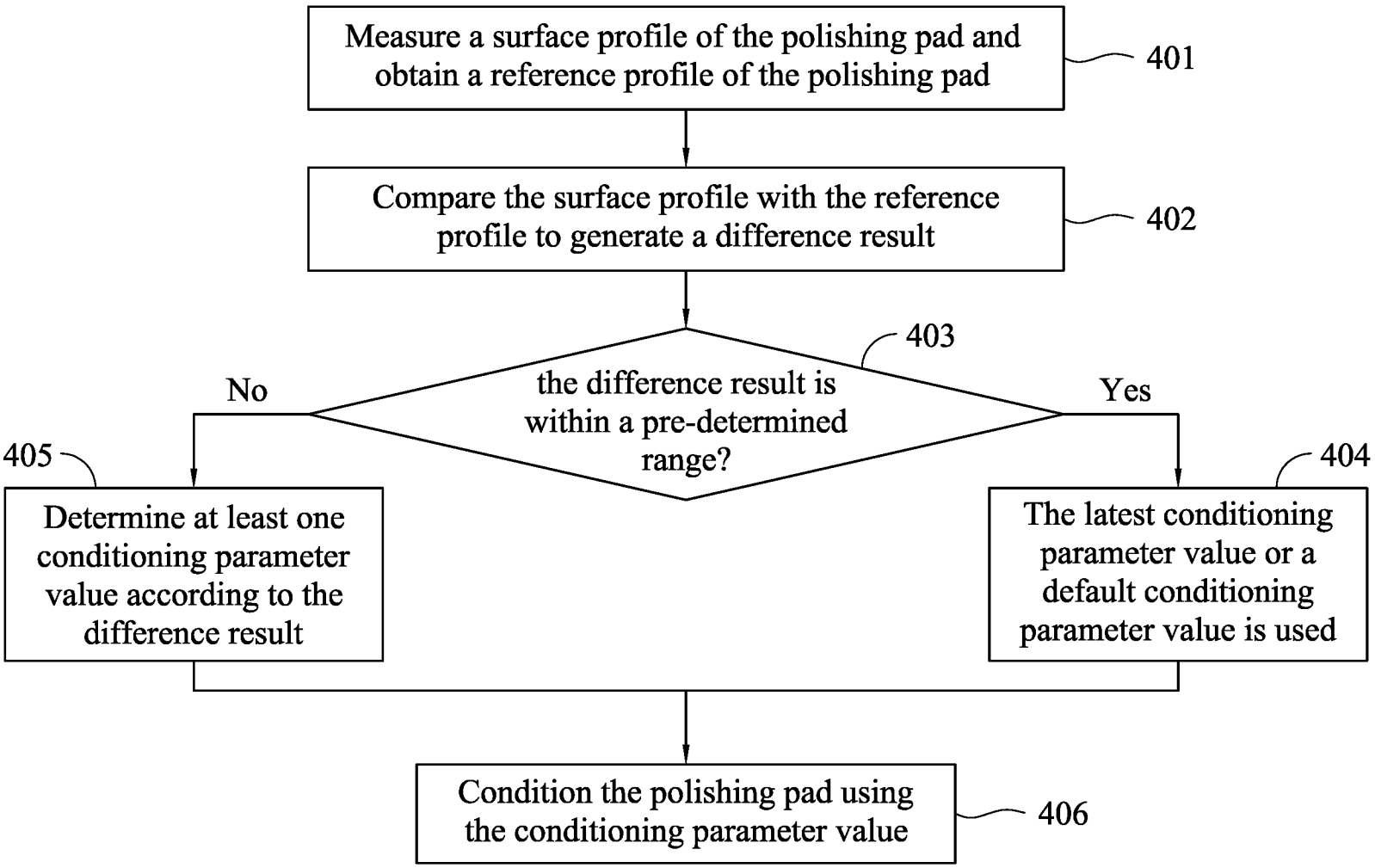
FIG. 4 is a diagram illustrating a flow chart of a method for CMP in accordance with some embodiments.

FIG. 4 is a diagram illustrating a flow chart of a method for CMP. Referring to FIG. 4, at operation 401, a surface profile of the polishing pad is measured, and a reference profile of the polishing pad is obtained. At operation 402, the surface profile is compared with a reference profile of the polishing pad to generate a difference result. At operation 403, it is determined whether the difference result is within a pre-determined range. If the result of the operation 403 is "yes", at operation 404, the latest conditioning parameter value or a default conditioning parameter value is used. If the result of the operation 403 is "no", at operation 405, a conditioning parameter value of the conditioner is determined according to the difference result. The conditioning parameter value may include a downforce value to a conditioner that urges the conditioner against the polishing pad or speed value of sweeping a conditioner across the polishing pad. At operation 406, the polishing pad is conditioned using the conditioning parameter value. In some embodiments, the operations 403 and 404 may be omitted, and thus the operation 405 is performed following the operation 402.

In some embodiments, a closed loop control is performed in the operation 405. The closed loop control may be performed in an in-situ mode or an ex-situ mode. In other words, the closed loop control may be performed simultaneously with the CMP operation, before the CMP operation, and/or after the CMP operation. In some embodiments, the chemical mechanical polishing operation is performed using the polishing pad after conditioning the polishing pad. In some embodiments, the CMP operation is performed using the polishing pad in which the chemical mechanical polishing operation and conditioning the polishing pad are performed at least partially simultaneously. In some embodiments, the CMP operation is performed using the polishing pad prior to measuring the surface profile of the polishing pad.

FIG. 5A to FIG. 5F are diagrams illustrating flow charts of the CMP operation in accordance with some embodiments. For simplification, the closed loop control is referred to as CLC.

Figure 5C:
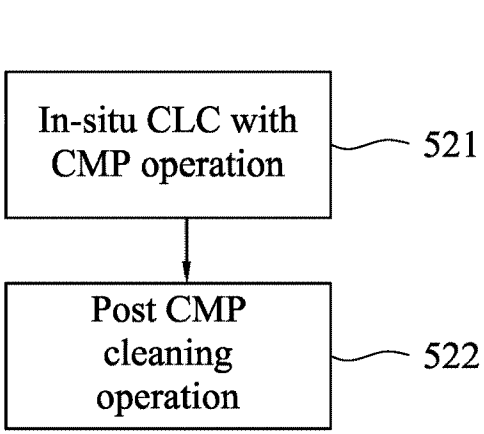
FIG. 5A to FIG. 5F are diagrams illustrating flow charts showing various CMP processes in accordance with some embodiments.
Figure 5B:
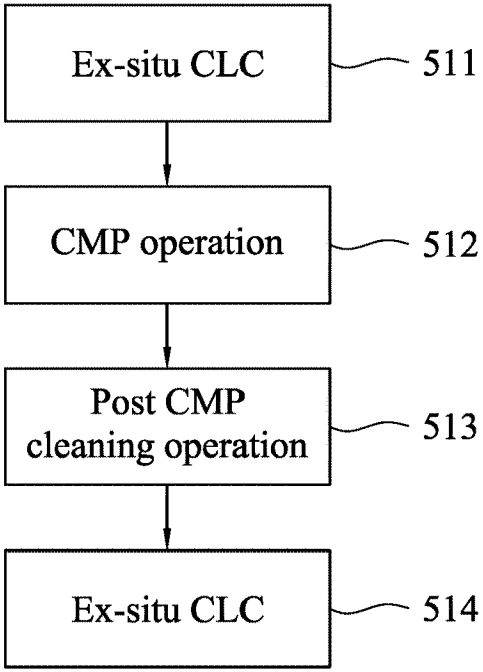
Figure 5A:
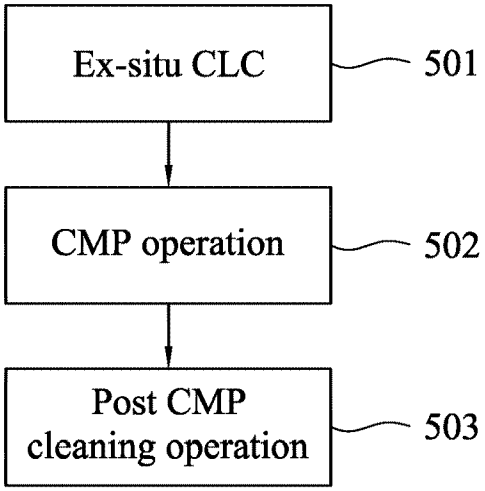

Referring to FIG. 5A, at operation 501, an ex-situ CLC is performed. At operation 502, CMP operation is performed. At operation 503, a post CMP cleaning operation is performed.

Referring to FIG. 5B, at operation 511, the ex-situ CLC is performed. At operation 512, CMP operation is performed. At operation 513, a post CMP cleaning operation is performed. At operation 514, the ex-situ CLC is performed to measure the profile of the polishing pad between wafer processing. The controller 116 can respond to the profile measurement by adjusting the conditioning parameter value of the polishing pad. As the conditioning parameter value is adjusted, the controller 116 will control the conditioner 110 to perform the CMP process for the next wafer.

Referring to FIG. 5C, at operation 521, an in-situ CLC is performed simultaneously with a CMP operation. The controller 116 can respond to the profile measurement by adjusting the conditioning parameter value immediately. At operation 522, the post CMP cleaning operation is performed.

Figure 5F:
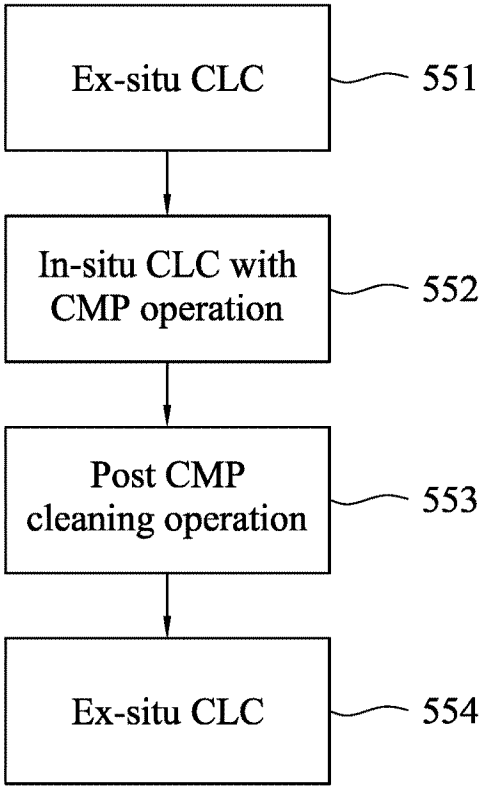
Figure 5E:
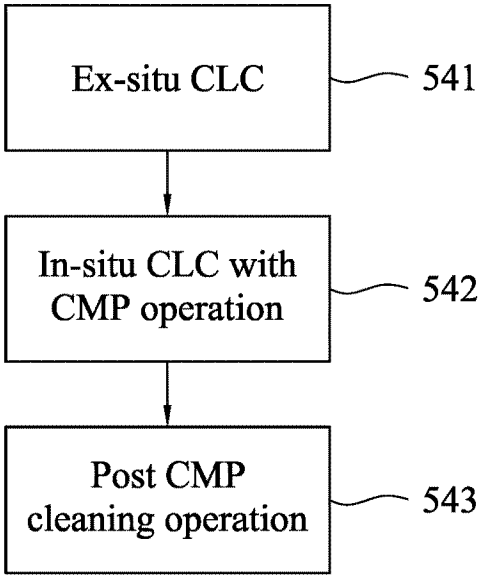
Figure 5D:
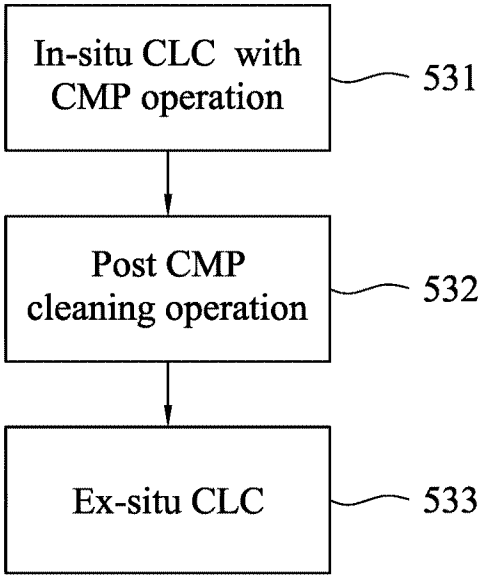

Referring to FIG. 5D, at operation 531, an in-situ CLC is performed simultaneously with a CMP operation. At operation 532, the post CMP cleaning operation is performed. At operation 533, an ex-situ CLC is performed.

Referring to FIG. 5E, at operation 541, an ex-situ CLC is performed. At operation 542, an in-situ CLC is performed simultaneously with CMP operation. At operation 543, the post CMP cleaning operation is performed.

Referring to FIG. 5F, at operation 551, an ex-situ CLC is performed. At operation 552, an in-situ CLC is performed simultaneously with CMP operation. At operation 553, the post CMP cleaning operation is performed. At operation 554, an ex-situ CLC is performed.

Those who are in the art should be able to appreciate the embodiments of FIG. 5A to FIG. 5F and arrange another combination of CLC, the CMP operation, and the post cleaning operation. The polishing pad profile measurements can be made ex-situ between wafer processing operations or in-situ during wafer processing. For ex-situ measurements, the slurry may be removed from the polishing pad before the thickness of the polishing pad is measured. This allows the system to avoid interference or errors in the thickness measurements due to the layer of slurry on the polishing pad. The polishing pad may be held stationary while the profile measurements are taken and then rotated so that all locations of the polishing pad are measured. Alternatively, the profile measurements can be takes while the polishing pad is rotating.

In some embodiments, the CLC is performed for every wafer. In some embodiments, the CLC is performed for every N wafers, where N is a positive integer greater than 1.

Figure 6:
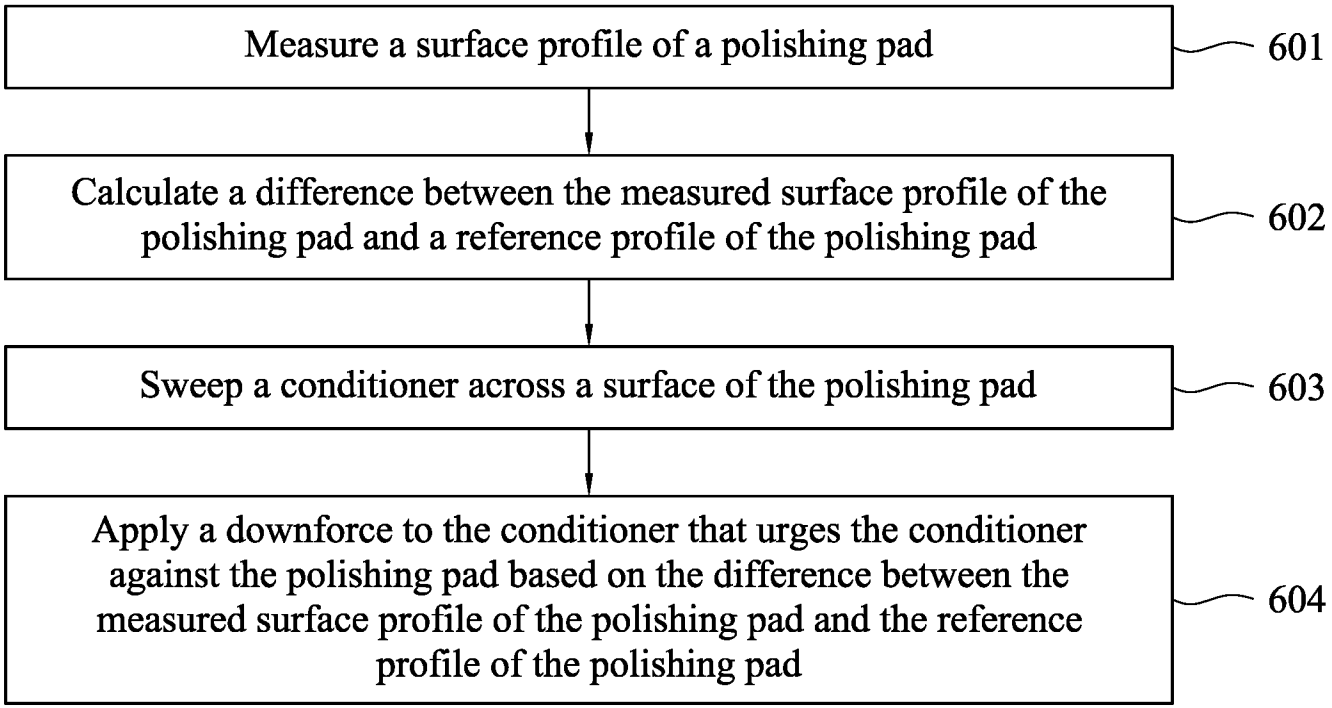
FIG. 6 is a diagram illustrating a flow chart of a method for conditioning a polishing pad in accordance with some embodiments.

FIG. 6 is a diagram illustrating a flow chart showing a method for conditioning a polishing pad in accordance with some embodiments. At operation 601, a surface profile of a polishing pad is measured. At operation 602, a difference between the measured surface profile of the polishing pad and a reference profile is calculated. At operation 603, a conditioner is swept across the surface of the polishing pad. At operation 604, a downforce is applied to the conditioner that urges the conditioner against the polishing pad based on the difference of the measured surface profile of the polishing pad and the reference profile. The operations of FIG. 6 have been described in detail above, and therefore the description will not be repeated.

Figure 7:
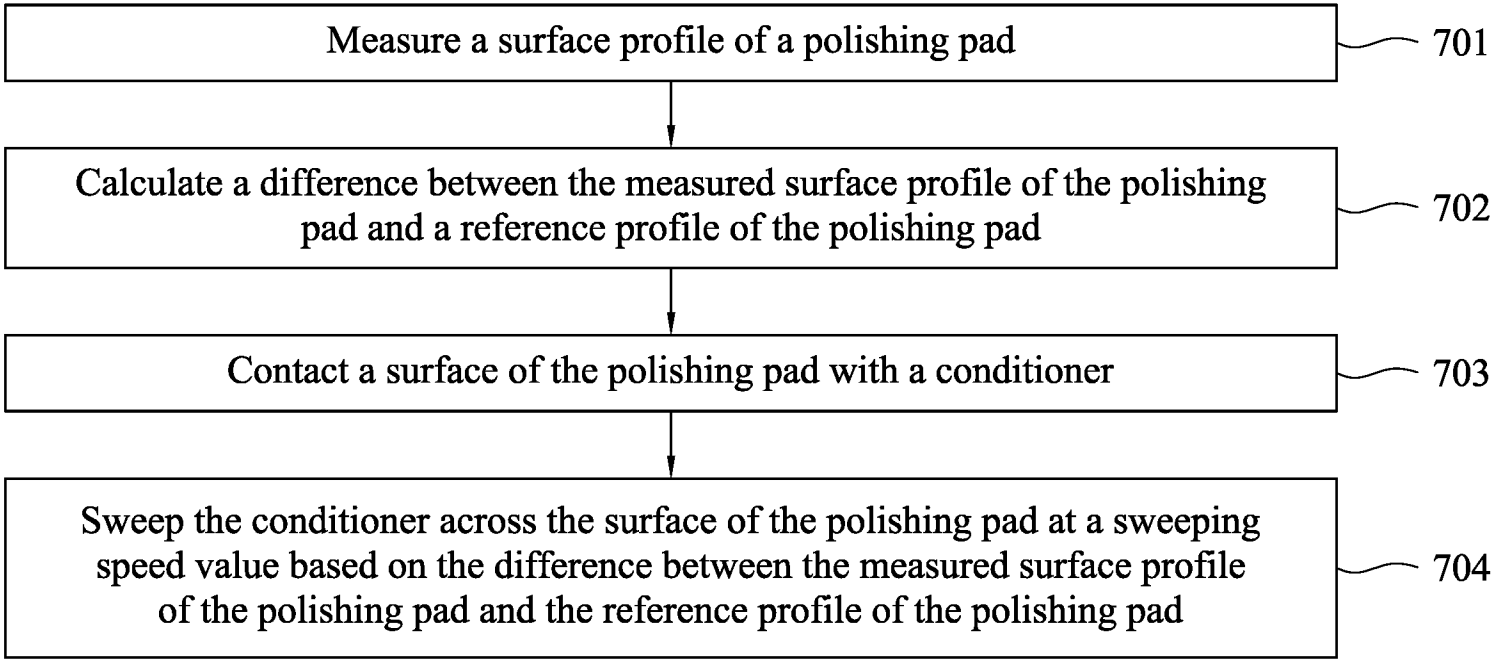
FIG. 7 is a diagram illustrating a flow chart of a method for conditioning a polishing pad in accordance with some embodiments.

FIG. 7 is a diagram illustrating a flow chart showing a method for conditioning a polishing pad in accordance with some embodiments. At operation 701, a surface profile of a polishing pad is measured. At operation 702, a difference between the measured surface profile of the polishing pad and a reference profile is calculated. At operation 703, a surface of the polishing pad is contacted with a conditioner. At operation 704, the conditioner is swept across the surface of the polishing pad at a sweeping speed value based on the difference between the measured surface profile of the polishing pad and the reference profile. The operations of FIG. 7 have been described in detail above, and therefore the description will not be repeated.

In some embodiments, the system detects the rotational position of the polishing pad, and a polar coordinate system may be the preferred means for defining the locations of the polishing pad associated with the thickness measurements. In other embodiments, the sensor(s) measures the thicknesses of the stationary polishing pad. The sensor may record one or more thicknesses and then be moved to a new position and stopped to measure additional thicknesses. The thicknesses of the entire polishing pad or representative locations of the polishing pad can be measured in a sequential manner. In these embodiments, the sensors may associate the thicknesses measurements of the polishing pad with X, Y location coordinates.

Different types of sensors can be used to measure the polishing pad thickness. Sensors suitable for polishing pad metrology include: laser, chromatic white light, inductive, CETR pad probe, ultrasonic, etc. The sensor(s) can be moved over the polishing pad in order to detect the pad thickness. The thickness detection can be performed during wafer processing or in between the processing of wafers. In some embodiments, the detection of the polishing pad thickness is performed when the polishing pad is covered with slurry, however other embodiments, the pad thickness detection is performed on a dry pad which requires the removal of the slurry.

Laser sensors direct a laser light at the polishing pad surface and the reflected light is detected. Based upon the reflected light, the distance between the sensor and the surface can be precisely calculated. Because the speed of light is constant, a pulse of laser light can be precisely and the system can detect the time it takes a light pulse to contact the surface being measured and receive the rebounded pulse. Alternatively, the light based distance measurement will be based upon interferometry. While the laser beam will most easily detect a clean polishing pad that has the slurry cleaned from the surface, it is also possible to detect the polishing pad thickness by directing the laser beam through a thin layer of slurry to the surface of the polishing pad and detecting the reflected light.

In some embodiments, a chromatic white light can be used to detect thickness of the polishing pad. A beam of light can be directed at the polishing pad and the reflected images are detected by a sensor, the diameter of the white light is substantially larger than that of a laser beam. Thus, fewer measurements may be required to determine the thicknesses of an entire polishing pad.

The proximity detector comprises an oscillating circuit composed of a capacitance in parallel with an inductance that forms the detecting coil which produces a magnetic field. The current flowing through the inductive loop changes when the sensor is in proximity to other objects and the change in current can be detected. By measuring the change in current, the distance to the object can be determined.

Mechanical probes can also be used to detect the polishing pad thickness. The probe is generally an elongated structure having an end that contacts the polishing pad. By knowing the extension of the probe from a fixed point to the surface of the polishing pad, the thickness of the polishing pad can be determined. It can be difficult to use the mechanical probe during the CMP process since the movement of the polishing pad may cause damage to the probe. Thus, in some embodiments, the probes are used to measure stationary polishing pads. Since the probe can be pressed through the slurry, the sensor readings will not be influenced by the slurry.

An ultrasonic sensor determines the thickness of the polishing pad by interpreting the echoes from ultra high frequency sound waves. Ultrasonic sensors generate high frequency sound waves and evaluate the echo which is received back by the sensor. Sensors calculate the time interval between sending the signal and receiving the echo to determine the distance to an object. By knowing the position of the sensor and receiver, the thickness of the polishing pad can be determined.

In some embodiments, a method is provided and includes: measuring a surface profile of a polishing pad; obtaining a reference profile of the polishing pad; comparing the surface profile of the polishing pad with the reference profile to generate a difference result; determining at least one conditioning parameter value according to the difference result; and conditioning the polishing pad using the conditioning parameter value.

In some embodiments, a method is provided and includes: measuring a surface profile of a polishing pad; calculating a difference between the measured surface profile of the polishing pad and a reference profile of the polishing pad; sweeping a conditioner across the surface of the polishing pad; and applying a downforce to the conditioner that urges the conditioner against the polishing pad based on the difference of the measured surface profile of the polishing pad and the reference profile.

In some embodiments, a method is provided and includes: measuring a surface profile of a polishing pad; calculating a difference between the measured surface profile of the polishing pad and a reference profile of the polishing pad; contacting a surface of the polishing pad with a conditioner; and sweeping the conditioner across the surface of the polishing pad at a sweeping speed value based on the difference between the measured surface profile of the polishing pad and the reference profile.

The foregoing outlines features of several embodiments so that those skilled in the art may better understand the aspects of some embodiments of the present disclosure. Those skilled in the art should appreciate that they may readily use some embodiments of the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the embodiments of the present disclosure, and that they may make various changes, substitutions, and alterations herein without departing from the spirit and scope of the embodiments of the present disclosure.

What is claimed is:

1. A method, comprising:

measuring a first thickness of a polishing pad at a first location of the polishing pad and a second thickness of the polishing pad at a second location of the polishing pad;

calculating a first thickness difference between the first thickness and a first reference thickness at the first location of the polishing pad;

calculating a second thickness difference between the second thickness and a second reference thickness at the second location of the polishing pad, wherein the second location is other than the first location, such that the first reference thickness is different from the second reference thickness, and wherein the second location is a location where a smallest thickness of the polishing pad occurs after processing at least one wafer using the polishing pad;

calculating a third thickness difference between the first thickness difference and the second thickness difference;

determining at least one conditioning parameter value according to the third thickness difference; and conditioning the polishing pad using a conditioner based on the at least one determined conditioning parameter value.

2. The method of claim 1, wherein the at least one conditioning parameter value comprises a value of a downforce to the conditioner that urges the conditioner against the polishing pad.

3. The method of claim 1, wherein the at least one conditioning parameter value comprises a sweeping speed value of the conditioner across the polishing pad.

4. The method of claim 1, wherein determining the at least one conditioning parameter value comprises determining whether the third thickness difference is within a predetermined range.

5. The method of claim 1, wherein the first reference thickness and the second reference thickness are thicknesses of the polishing pad prior to processing a wafer.

6. The method of claim 1, wherein the first reference thickness and the second reference thickness are thicknesses of the polishing pad after processing the at least one wafer.

7. The method of claim 1, further comprising:

performing a chemical mechanical polishing operation using the polishing pad after conditioning the polishing pad.

8. The method of claim 1, further comprising:

performing a chemical mechanical polishing operation using the polishing pad, wherein the chemical mechanical polishing operation and conditioning the polishing pad are performed at least partially simultaneously.

9. The method of claim 1, further comprising:

performing a chemical mechanical polishing operation using the polishing pad prior to measuring the first thickness of the polishing pad at the first location of the polishing pad and the second thickness of the polishing pad at the second location of the polishing pad.

10. The method of claim 1, wherein determining the at least one conditioning parameter value comprises comparing the third thickness difference with a pre-determined value, and conditioning the polishing pad comprises increasing a downforce value of the conditioner in response to the third thickness difference being greater than the pre-determined value.

11. The method of claim 1, wherein determining the at least one conditioning parameter value comprises comparing the third thickness difference with a pre-determined value, and conditioning the polishing pad comprises decreasing a sweeping speed of the conditioner in response to the third thickness difference being greater than the pre-determined value.

12. The method of claim 1, wherein when the third thickness difference is greater than a pre-determined value, conditioning the polishing pad comprises increasing a downward force of the conditioner.

13. The method of claim 1, wherein when the third thickness difference is greater than a pre-determined value, conditioning the polishing pad comprises decreasing a sweeping speed of the conditioner.

14. A method, comprising:

calculating a first thickness tendency at a location (j) of a polishing pad, wherein the first thickness tendency is $t_{cur,j+1}-t_{cur,j-1}$, the $t_{cur,j+1}$ is a thickness of the polishing pad at a location (j+1), and the $t_{cur,j-1}$ is a thickness of the polishing pad at a location (j−1);

calculating a second thickness tendency at the location (j+1) of the polishing pad, wherein the second thickness tendency is $t_{cur,j+2}-t_{cur,j}$, the $t_{cur,j+2}$ is a thickness of the polishing pad at a location (j+2), and the $t_{cur,j}$ is a thickness of the polishing pad at a location (j);

determining a first parameter value with respect to the location (j) based on the first thickness tendency and a first reference thickness tendency, wherein the first reference thickness tendency is $t_{cur-k,j+1}-t_{cur-k,j-1}$, the $t_{cur-k,j+1}$ is a thickness of a reference polishing pad at the location (j+1), and the $t_{cur-k,j-1}$ is a thickness of the reference polishing pad at the location (j−1);

determining a second parameter value with respect to the location (j+1) based on the second thickness tendency and a second reference thickness tendency, wherein the second reference thickness tendency is $t_{cur-k,j+2}-t_{cur-k,j}$, the $t_{cur-k,j+2}$ is a thickness of the reference polishing pad at the location (j+2), and the $t_{cur-k,j}$ is a thickness of the reference polishing pad at the location (j);

sweeping a conditioner across a surface of the polishing pad;

applying a first downforce to the conditioner that urges the conditioner against the location (j) of the polishing pad according to the first parameter value; and applying a second downforce to the conditioner that urges the conditioner against the location (j+1) of the polishing pad according to the second parameter value.

15. The method of claim 14, wherein applying the first downforce comprises varying a value of the first downforce while sweeping the conditioner across the surface of the polishing pad.

16. The method of claim 14, wherein the first parameter value is different from the second parameter value.

17. The method of claim 14, wherein when the first thickness tendency is greater than the first reference thickness tendency, determining the first parameter value comprises increasing a downward force value of the conditioner.

18. A method, comprising:

measuring a first thickness of a polishing pad at a first location of the polishing pad and a second thickness of the polishing pad at a second location of the polishing pad;

obtaining a first reference thickness at the first location of the polishing pad and a second reference thickness at the second location of the polishing pad, wherein the second location is other than the first location, such that the first reference thickness is different from the second reference thickness;

calculating a first thickness variation based on the first thickness and the first reference thickness at the first location, and a second thickness variation based on the second reference thickness and the second reference thickness at the second location, wherein the second location is a location where a smallest thickness of the polishing pad occurs after processing at least one wafer using the polishing pad;

calculating a difference between the first thickness variation and the second thickness variation;

contacting a surface of the polishing pad with a conditioner; and sweeping the conditioner across the surface of the polishing pad at a sweeping speed value based on the difference between the first thickness variation and the second thickness variation.

19. The method of claim 18, wherein sweeping the conditioner comprises varying the sweeping speed value.

20. The method of claim 18, further comprising:

applying a downforce to the conditioner that urges the conditioner against the polishing pad while sweeping the conditioner across the surface of the polishing pad; and varying a value of the downforce while sweeping the conditioner across the surface of the polishing pad.

* * * * *